US005911298A

United States Patent [19]

Puttkammer et al.

[11] Patent Number: 5,911,298

[45] Date of Patent: Jun. 15, 1999

[54] MULTI-COMPACT-SENSOR ADAPTED FOR MOUNTING AT AN ASCENDING ANGLE

[75] Inventors: Frank Puttkammer; Torsten Wolf, both of Coswig, Germany

[73] Assignee: WHD Elektronische Prueftechnik GmbH., Dresden, Germany

[21] Appl. No.: 08/952,405

[22] PCT Filed: May 10, 1996

[86] PCT No.: PCT/DE96/00874

§ 371 Date: Mar. 2, 1998

§ 102(e) Date: Mar. 2, 1998

[87] PCT Pub. No.: WO96/36019

PCT Pub. Date: Nov. 14, 1996

[30] Foreign Application Priority Data

May 12, 1995 [DE] Germany ..... 195 18 229

[51] Int. Cl.[6] ..... G07F 7/04

[52] U.S. Cl. ..... 194/206

[58] Field of Search ..... 194/206, 207; 250/556; 382/135; 209/534

[56] References Cited

U.S. PATENT DOCUMENTS

| | | | |
|---|---|---|---|
| 4,120,389 | 10/1978 | Erickson . | |
| 4,734,869 | 3/1988 | Mickowski . | |
| 4,881,268 | 11/1989 | Uchida et al. | 382/135 |
| 4,986,410 | 1/1991 | Shields . | |
| 5,286,017 | 2/1994 | Hawk et al. | 194/206 |

FOREIGN PATENT DOCUMENTS

| | | | |
|---|---|---|---|
| 2541405 | 3/1977 | Germany | F16P 7/00 |
| 3322279 | 12/1984 | Germany | G01P 5/00 |
| 661603 | 7/1987 | Switzerland | 194/207 |
| 2016141 | 9/1979 | United Kingdom . | |

*Primary Examiner*—F. J. Bartuska
*Assistant Examiner*—Bryan J. Jaketic
*Attorney, Agent, or Firm*—Karl Hormann

[57] ABSTRACT

In accordance with the invention, a multi-compact-sensor is provided with a sensor support for receiving different and exchangeable sensors, brackets and supports for assembly into existing and/or new processing machines at a ascending angle, a board which contains the evaluation circuitry and elements for connection with the sensors as well as, depending on intended use and objects to be tested, an exchangeable cover. The combining of a plurality of individual components, the inventive exchangeability of different sensors, the versatility of the possibilities of use and the handling of the sensors and evaluation electronics into a component of compact structure justify calling the inventive device a multi-compact-sensor.

20 Claims, 3 Drawing Sheets

MULTI-COMPACT-SENSOR ADAPTED FOR MOUNTING AT AN ASCENDING ANGLE

BACKGROUND OF THE INVENTION

Field of the Invention

This invention relates to a testing device for use in processing machines of the type useful for processing documents and, more particularly, apparatus for checking the authenticity of test objects such as paper money, bank notes and the like.

Hitherto, position-related tests have been carried out by means of various pressure devices. For example, a device for feeding tickets and magnetic cards into a magnetic card reader is described in German laid-open patent specification 41 22 916. Rollers and pressure springs are utilized for guidance in a defined manner. Similar guides, in particular contacting and measuring rollers journaled to be freely rotatable, are used in accordance with German laid-open patent specification 40 16 961 disclosing a method of measuring and a device for determining the electrical surface resistance of metallic strips.

The known pressure devices are subject to wear and tear and they contribute to the deterioration of the test objects. German laid-open patent specification 35 13 635 describes a device for receiving, testing and storing monetary notes, whereby positional or alignment testing is performed by means of a gap in a roller, thus leading to similar disadvantages as described above. German patent 40 37 333 describes an adapter for contacting passive structural components with a measuring and testing device utilizing fixed and movable contact elements and pneumatically movable contact pins. This manner of positioning test objects is very complex and may be applied to but few processing machines. U.K. patent application 2 016 141 describes a system for detecting the presence of a test object within a defined range. Since distance is to be measured, pressure means are not to be used.

The pressure means used in testing devices for authenticity checks serve to render these devices functionally reliable. The known pressure devices are subject to wear and tear and contribute to additional deterioration of the test objects.

OBJECTS OF THE INVENTION

It is the object of the invention so to construct a device in processing machines for the detection of security indicia on objects to be checked that pressure devices hitherto required for guiding test objects at a defined spacing relative to, and/or in contact with, the testing device need no longer be provided, and to connect the device to the testing electronics in a compact manner so as to ensure simple handling.

BRIEF SUMMARY OF THE INVENTION

In accordance with the invention, a compact device for the detection of security indicia on objects to be checked is provided with the following components: a sensor support for receiving different and exchangeable sensors, brackets and fixtures for assembly into existing and/or new processing machines, a board containing the evaluation circuit and contacts for connection with the sensors, as well as, depending on intended use and type of objects to be checked, an exchangeable cover. Because of the combination of a plurality of individual components, the exchangeability in accordance with the invention of many different kinds of sensors, the versatility of possible applications and the handling of sensors and evaluation electronic circuitry in one compact component, the device in accordance with to the invention may justly be called a multi-compact sensor.

During operation, an object to be checked is fed to the multi-compact sensor by means of conveyor devices in a predetermined disposition and at a defined velocity. Impermissible deviations are detected by sensors and result in an interruption of the normal operation. As is known, the test objects are moved in processing machinery by transport rollers, for instance. Whenever a test object encounters an obstacle, for example an ascending plane, the banknote is pressed against the obstacle. Rather than by any kind of pressure elements this force is generated by the motion as such of the banknote. It is for this reason that in accordance with the invention the test sensor system is arranged within the ascending plane, for in this area the spacing between the test object and the sensors is smallest. It is because of the pressed engagement that the testing operation is reproducible. Even test objects which are mechanically defective, particularly because of creases, can in accordance with the invention be checked for their authenticity, as the security indicia are spaced closer to the sensors as a result of being pressed against the sensors. The smaller the distance between security indicia of the test object and the sensors, the higher is the reliability of the test. By making use of the forces acting on the test object, which because of a defined contact between the test object and the device in accordance with the invention are not parallel to the direction of movement, the test object is positively guided such that testing is carried out by sensors spaced at a certain distance and/or in engagement with the test object. The test is performed by sensors incorporated in the device and operating singly or in combination in defined ways adapted to the test object. The sensor signals are converted into machine-specific signals by means of an electronic evaluation system which is also mounted on the device, for initiating a defined function of the processing machine, depending on a given application.

BRIEF DESCRIPTION OF THE SEVERAL DRAWINGS

Aside from the claims, the characteristics of the invention will also appear from the description and drawings, whereby each individual feature either by itself or in any subcombination constitutes an advantageous patentable embodiment for which protection is claimed in respect of the sensor support as well as in respect of the arrangement of the sensors. An embodiment of the invention is depicted in the drawings and will be explained in greater detail with reference to the following embodiment. In the drawings:

DETAILED DESCRIPTION OF PREFERRED EMBODIMENTS

Figure 1:
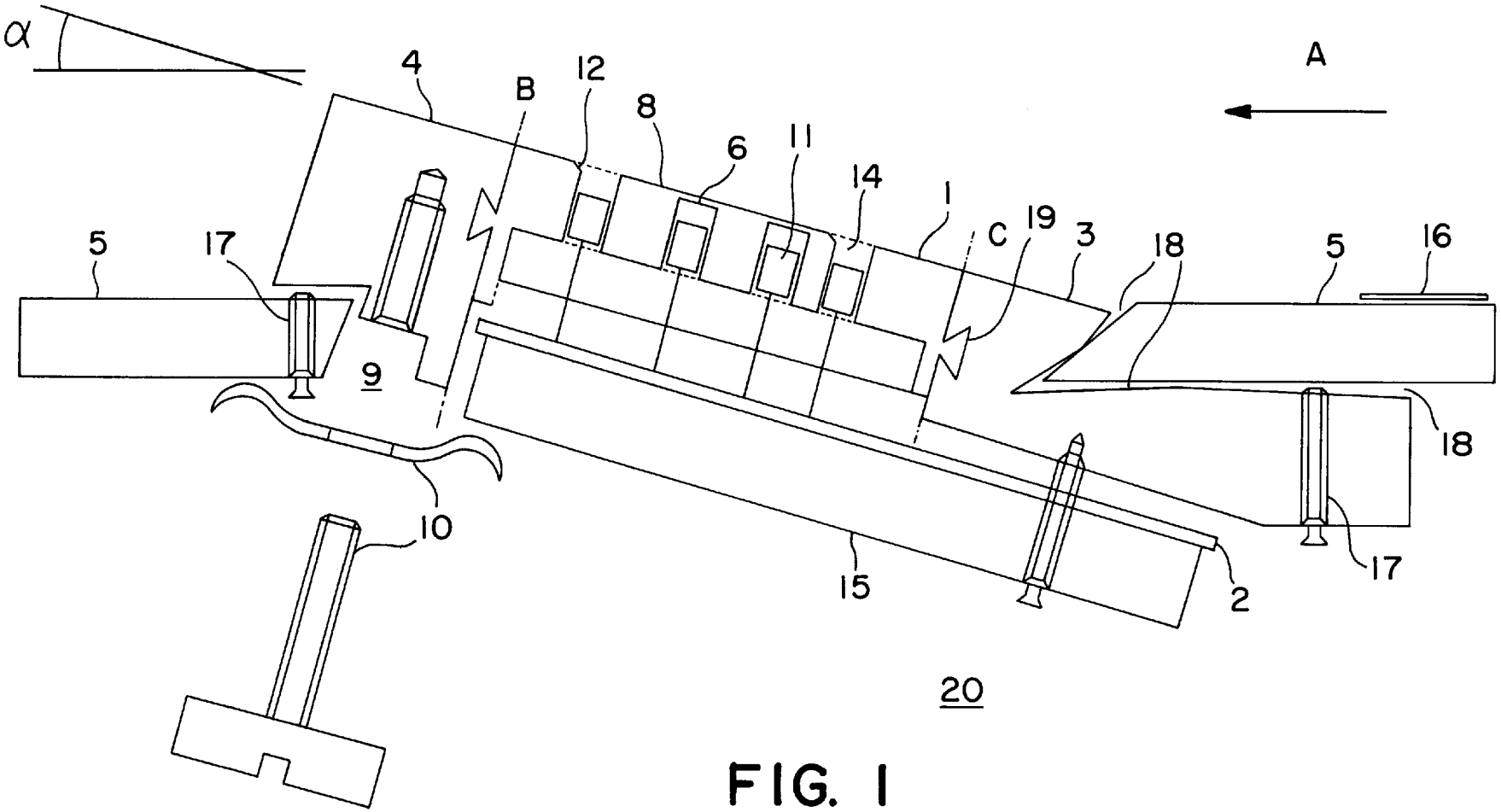
FIG. 1 is a sectional view of the multi-compact sensor.

As shown in FIG. 1, a testing device, hereinafter referred to as multi-compact sensor 20, for the detection of security indicia on objects to be tested comprises a sensor support 1 and a board 2 which are attached to guide plates 5 in openings 9 provided in parts of a processing machine, by brackets, in particular a snap-on bracket 3 and a fixing bracket 4. The test plane 8 is inclined at a predetermined angle α relative to the direction of movement A of the test object 16, so that the test object 16 is positively guided towards the sensors 11 in a predetermined disposition. The snap-on bracket 3 and the fixing bracket 4 correspond to the opening edges of the guide plate 5 by means of recesses 18 such that it is possible during assembly to change the angle a by adjustment devices 17. To this end, the angle α depends upon the operating status of the processing machine and upon the function of the sensors 11 and may be varied between 5° and 30°. The guide plate 5 is beveled, more particularly by V-grooving and/or chamfering, so as to avoid twisting, jamming, folding or rolling of the test object 16. The snap-on bracket 3 and the fixing bracket 4 are connected to the sensor support 1 along interfaces B; C by arresting devices, preferably dovetail arresting devices 19.

Sensor receptacles 6 closed toward the testing plane 8 and/or sensor compartments 14 which open towards the testing plane 8 are provided in the sensor support 1 by perforations, recesses, grooves and the like. The rear edges 12 of the sensor compartments 14, as seen in the direction of movement A, are beveled and/or chamfered to prevent rotating, jamming or changes in the geometric configuration of the test object, particularly by buckling, folding, rolling or tearing. The open sensor compartments 14 may be selectively closable by covers 7 made from materials which do not lead to distortions of the measurements, preferably glass or polycarbonate, so that the test plane 8 is configured as a slide surface which prevents undesired changes in the alignment and/or geometry of the test object 16. A plurality of sensor receptacles 6 and/or the sensor compartments 14 are arranged in the sensor support I in parallel succession and/or diagonal succession and/or in a strip-like pattern, with their longest dimension extending transversely of the direction of movement A. The sensors 11 provided in the sensor receptacles and/or sensor compartments are electrically connected with the board 2 through one or more channel ducts 13. The connection may be releasable, as by contact blades, or permanent. The sensor receptacles 6 and/or the sensor compartments 14 serve selectively to accommodate electrical and/or magnetic and/or opto-electronic sensors, singly or in combination. Other conceivable sensors would be, depending on the field of application, humidity and/or pressure sensors, in particular. The board 2 containing the evaluation electronics is enclosed by a protective shield 15 affixed by fasteners 10, in particular screw or spring fasteners.

Figure 2:
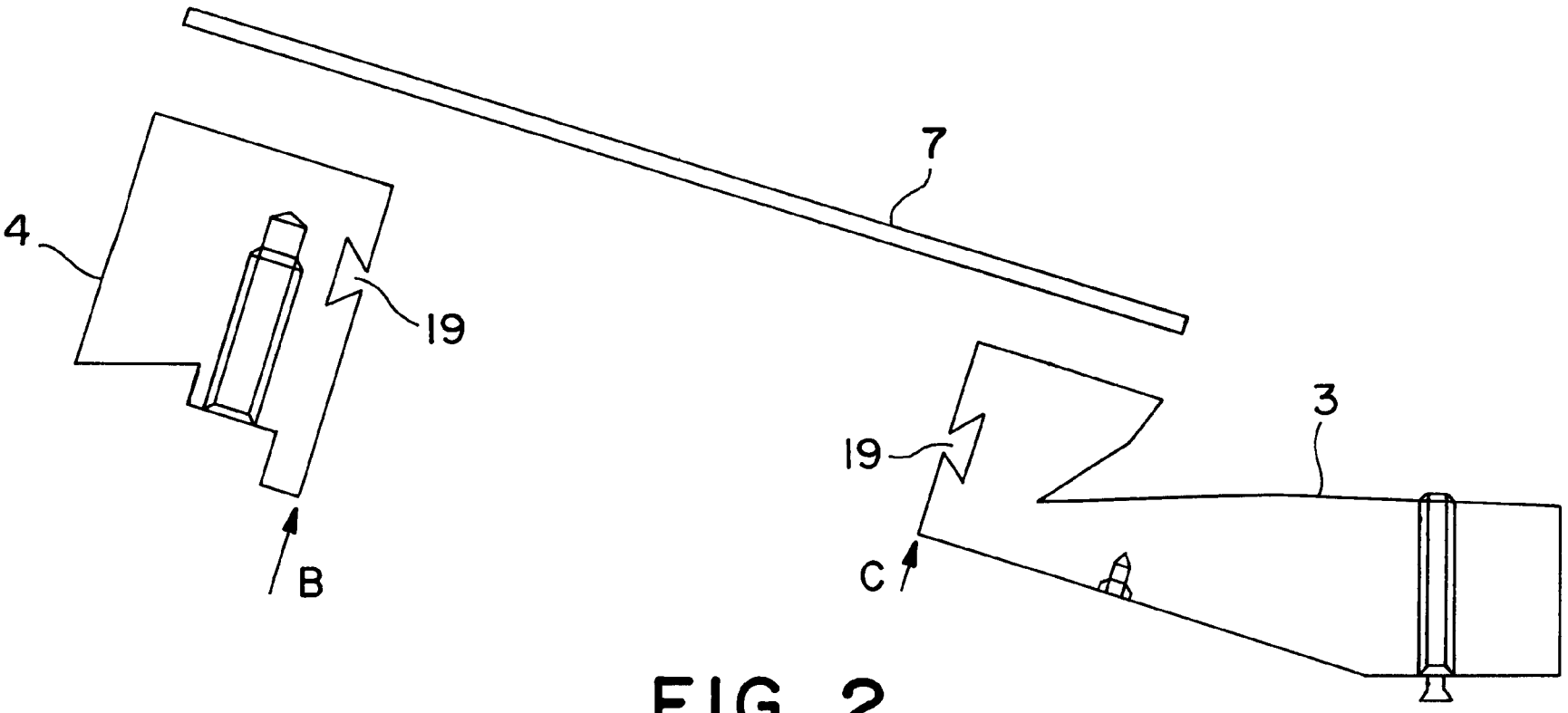
FIG. 2 is a sectional view of the snap-on and fixing bracket with a sensor cover.

FIG. 2 depicts snap-on bracket 3, insertion bracket 4 and sensor cover 7 without the sensor support 1. The brackets made by injection molding may thus be easily exchanged, and different brackets mounted in many different ways may be used in different processing machines.

Figure 3:
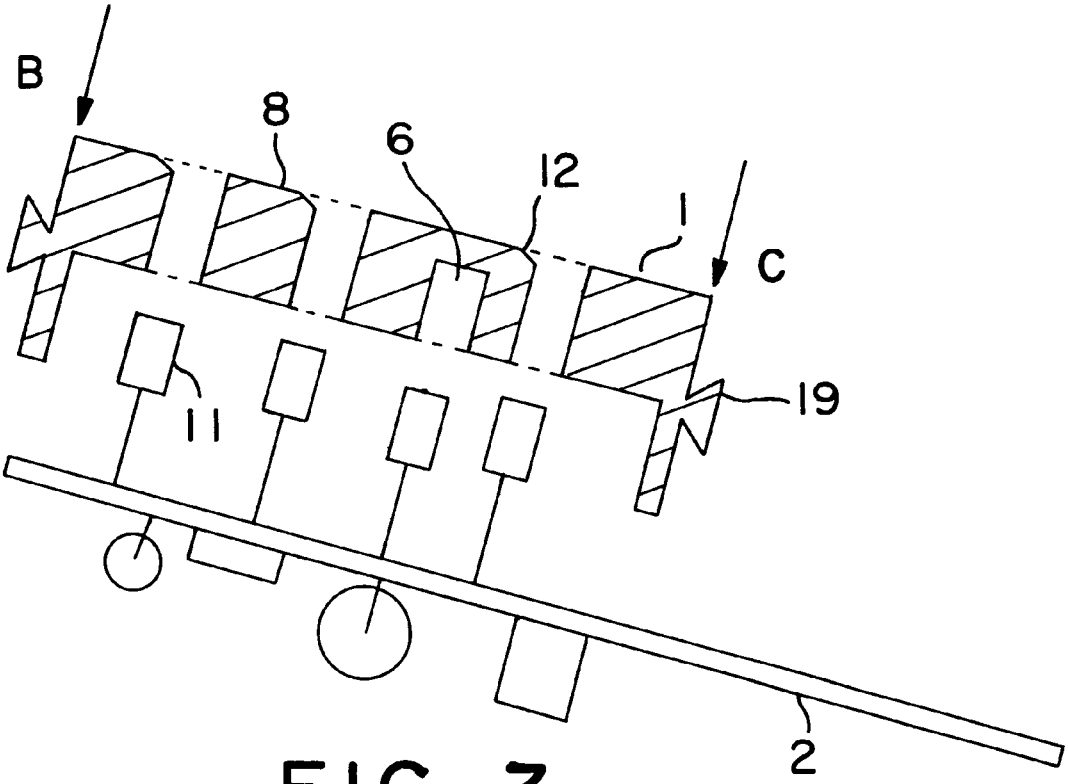
FIG. 3 is a sectional view of the sensor support and board with plugged-in sensors.

FIG. 3 shows a section of the multi-compact sensor 20 comprising the board 2 without the protective shield 15 with sensors 11 connected in pre-assembly and the sensor carrier 1 with the sensor receptacles 6 and sensor snap-in compartments 14 the rear edges 12, seen in the direction of movement A, are chamfered.

Figure 4:
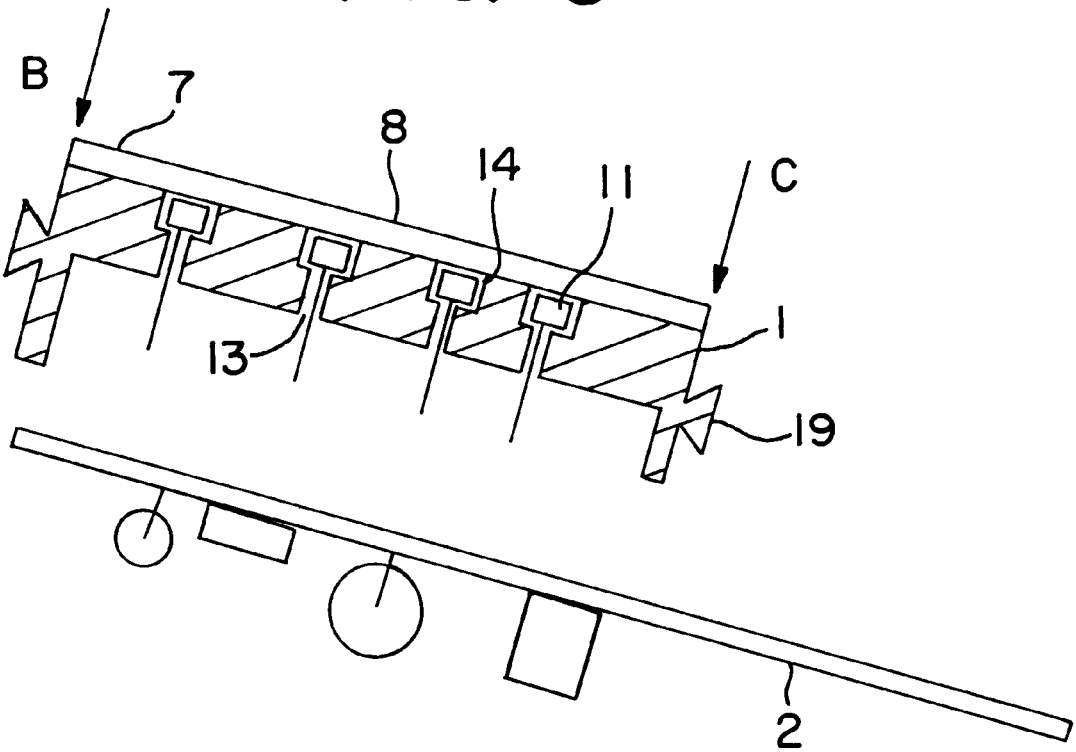
FIG. 4 is a sectional view of the sensor support with embedded sensors.

FIG. 4 is a partial view of the multi-compact sensor 20 comprising the board 2 with sensors 11 inserted in the sensor receptacle 6 and the sensor support 1. The sensors 11 are connected to the board 2 by contact blades or springs through channel ducts 13. The material used for the sensor cover 7 is of the kind which does not distort the measurements of the sensors therebelow. Glass and polycarbonate are particularly suitable for this purpose. The use of one type of machine may necessitate a different sensor arrangement for different testing methods, depending upon customers' desires. To this end, snap-in bracket 3 and insertion bracket 4 are retained unchanged, and only the sensor carrier 1 and its underlying board 2 are replaced.

What is claimed is:

1. An apparatus for checking the authenticity of a predetermined object and adapted to be mounted in a gap formed between substantially opposite edges of mounting webs provided in a document processing machine provided with a plane of movement for said object, comprising:

bracket means having substantially opposite surfaces provided with means for engaging said opposite edges;

means adapted to be secured in said bracket means and provided with means for accommodating at least one sensor, said means for accommodating said sensor means comprising a substantially planar surface intersecting said plane of movement at a predetermined ascending angle thereby to provide positive guidance to said object;

board means positioned below said accommodating means and operatively connected to said at least one sensor.

2. The apparatus of claim 1, wherein said means for accommodating said at least one sensor is secured in said bracket means by complementary groove and feather means.

3. The apparatus of claim 2, wherein said groove and feather means comprises intermeshing dovetail structures in said bracket means and said accommodating means.

4. The apparatus of claim 1, wherein said means for accommodating said at least one sensor means comprises receptacle means forming an opening in said planar surface.

5. The apparatus of claim 4, wherein said opening is provided with an edge of beveled configuration in the direction of movement of said object.

6. The apparatus of claim 4, wherein said opening is covered by a material of the kind not interfering with said at least one sensor.

7. The apparatus of claim 6, wherein said material is from the group comprising glass and polycarbonate.

8. The apparatus of claim 1, wherein said means for accommodating said at least one sensor comprises a substantially enclosed compartment.

9. The apparatus of claim 1, wherein said means for accommodating said at least one sensor comprises a plurality of elongate recesses having their major dimension extending normal to the direction of movement of said object.

10. The apparatus of claim 9, wherein said recesses are arranged in parallel succession.

11. The apparatus of claim 1, wherein said means for accommodating said at least one sensor comprises a plurality of elongate recesses having their major dimensions arranged in diagonal succession.

12. The apparatus of claim 9, wherein said recesses are arranged in a strip-like pattern.

13. The apparatus of claim 1, wherein said means for accommodating said at least one sensor is provided with channel duct means for connector means between said at least one sensor means and said board means.

14. The apparatus of claim 13, wherein said at least one sensor means is releasably connected to said board means.

15. The apparatus of claim 14, wherein said releasable connection between said at least one sensor means and said board means comprises spring contact means.

16. The apparatus of claim 13, wherein said connection between said at least one sensor means and said board means is permanent.

17. The apparatus of claim 13, wherein said means for accommodating said at least one sensor means comprises means for accommodating sensor means of the type consisting of electronic, opto-electronic, magnetic, humidity and pressure sensor means.

18. The apparatus of claim 1, wherein said board means is enclosed by shield means.

19. The apparatus of claim 18, wherein said shield means is secured to said bracket means by spring biased screw means.

20. The apparatus of claim 1, further comprising means for varying said angle between 5° and 30°.

* * * * *